US011380162B2

(12) United States Patent
Danielson et al.

(10) Patent No.: US 11,380,162 B2
(45) Date of Patent: Jul. 5, 2022

(54) GAMING SYSTEM PROVIDING A SHARABLE JOINT CREDIT METER

(71) Applicant: IGT, Las Vegas, NV (US)

(72) Inventors: Patrick Danielson, Las Vegas, NV (US); Dwayne Nelson, Las Vegas, NV (US); Vincent Lai, Las Vegas, NV (US)

(73) Assignee: IGT, Las Vegas, NV (US)

( * ) Notice: Subject to any disclaimer, the term of this patent is extended or adjusted under 35 U.S.C. 154(b) by 317 days.

(21) Appl. No.: 16/668,307

(22) Filed: Oct. 30, 2019

(65) Prior Publication Data

US 2021/0134111 A1 May 6, 2021

(51) Int. Cl.
*G07F 17/32* (2006.01)
*G07F 17/34* (2006.01)

(52) U.S. Cl.
CPC ..... *G07F 17/3244* (2013.01); *G07F 17/3213* (2013.01); *G07F 17/3225* (2013.01); *G07F 17/34* (2013.01)

(58) Field of Classification Search
CPC ..... G07F 17/34
See application file for complete search history.

(56) References Cited

U.S. PATENT DOCUMENTS 6,319,122 B1 11/2001 Packes, Jr. et al.
6,379,248 B1 4/2002 Jorasch et al.
6,577,733 B1 6/2003 Charrin
7,361,085 B2 4/2008 Packes, Jr. et al.
7,905,775 B2 3/2011 Walker et al.
7,993,198 B2 8/2011 Walker et al.
8,187,086 B2 5/2012 Young
8,272,947 B2 9/2012 Gagner et al.
8,442,918 B2 5/2013 Gabriele et al.
8,444,481 B2 5/2013 Walker et al.
8,512,120 B2 8/2013 Nelson et al.
8,864,135 B2 10/2014 Baerlocher et al.
9,443,385 B2 9/2016 Adiraju et al.
9,508,220 B2 11/2016 Walker et al.
9,824,523 B2 11/2017 Cannon et al.
10,002,493 B2 6/2018 Walker et al.
2002/0183105 A1 12/2002 Cannon et al.
2002/0198044 A1 12/2002 Walker et al.
2003/0171145 A1 9/2003 Rowe
2003/0195037 A1 10/2003 Vuong et al.
2005/0096126 A1 5/2005 Prasad et al.
2005/0187012 A1 8/2005 Walker et al.
2006/0247012 A1 11/2006 Walker et al.
2006/0287073 A1 12/2006 Walker et al.
2007/0054726 A1 3/2007 Muir et al.
2007/0155497 A1 7/2007 Okada
2009/0111573 A1 4/2009 Iddings
2010/0004053 A1 1/2010 Acres
2010/0004054 A1 1/2010 Acres
2010/0004058 A1 1/2010 Acres
2010/0016070 A1 1/2010 Walker et al.
2010/0197385 A1 8/2010 Aoki et al.
2011/0045896 A1 2/2011 Sak et al.

(Continued)

*Primary Examiner* — Robert T Clarke, Jr.
(74) *Attorney, Agent, or Firm* — Neal, Gerber & Eisenberg LLP

(57) ABSTRACT

Gaming systems and methods that enable multiple players to share credit meters on electronic gaming machines.

20 Claims, 9 Drawing Sheets

(56) References Cited

U.S. PATENT DOCUMENTS

| | | | | |
|---|---|---|---|---|
| 2011/0159940 | A1* | 6/2011 | Acres | G07F 17/3276 463/11 |
| 2012/0046111 | A1 | 2/2012 | Walker et al. | |
| 2012/0122565 | A1 | 5/2012 | Mishra | |
| 2012/0302328 | A1 | 11/2012 | Walker et al. | |
| 2013/0012293 | A1 | 1/2013 | Walker et al. | |
| 2013/0072289 | A1* | 3/2013 | Nelson | G07F 17/3225 463/25 |
| 2013/0310161 | A1 | 11/2013 | Walker et al. | |
| 2014/0045579 | A1 | 2/2014 | Filipour et al. | |
| 2014/0121006 | A1 | 5/2014 | Johnson | |
| 2014/0274252 | A1 | 9/2014 | Chun | |
| 2015/0348021 | A1 | 12/2015 | Rader et al. | |
| 2017/0263079 | A1 | 9/2017 | Walker et al. | |
| 2018/0040200 | A1 | 2/2018 | Ellis | |
| 2019/0188963 | A1* | 6/2019 | Higgins | G06Q 20/3674 |

* cited by examiner

1000

GAMING SYSTEM PROVIDING A SHARABLE JOINT CREDIT METER

BACKGROUND

The present disclosure relates to gaming systems, and specifically gaming systems that provide a shareable joint credit meter for two or more players of electronic gaming machines of the gaming system.

Gaming systems may provide for player use of monetary currency or credits that represent monetary currency for plays of wagering games. Gaming systems may display the player credit balance in a credit meter.

BRIEF SUMMARY

Various embodiments of the present disclosure provide a gaming system including a processor and a memory device storing a plurality of instructions, that when executed by the processor, cause the processor to receive first credit data regarding a first credit amount displayed via a first individual credit meter of a first display device of a first electronic gaming machine, receive second credit data regarding a second credit amount on a second individual credit meter of a second electronic gaming machine, displayed via a second individual credit meter of a second display device of a second electronic gaming machine, and maintain, for a joint credit meter, a joint credit balance comprising the first credit amount and the second credit amount. The plurality of instructions, when executed by the processor, further cause the processor to communicate data that results in the first electronic gaming machine displaying, via the first display device, the joint credit balance in the joint credit meter, and communicate data that results in the second electronic gaming machine displaying, via the second display device, the joint credit balance in the joint credit meter.

Various embodiments of the present disclosure provide a gaming system including a processor and a memory device storing a plurality of instructions, that when executed by the processor, cause the processor to maintain a joint credit balance for a joint credit meter for each of a first electronic gaming machine and a second electronic gaming machine. The plurality of instructions, when executed by the processor, further cause the processor to communicate data that results in a display of the joint credit balance in the joint credit meter via a first display device of the first electronic gaming machine, and communicate data that results in a display of the joint credit balance in the joint credit meter via a second display device of the second electronic gaming machine. The plurality of instructions, when executed by the processor, further cause the processor to communicate data that results in a first credit amount equal to the joint credit balance to be displayed via a first individual credit meter of the first display device of the first electronic gaming machine, and communicate data that results in a second credit amount equal to a zero balance to be displayed via a second individual credit meter of the second display device of the second electronic gaming machine.

Various embodiments of the present disclosure provide a gaming system including a processor and a memory device storing a plurality of instructions, that when executed by the processor, cause the processor to: cause a joint account maintained by a gaming establishment fund management system to maintain a joint credit balance for a joint credit meter for a first electronic gaming machine and a second electronic gaming machine. The plurality of instructions, when executed by the processor, further cause the processor to communicate data that results in a display of the joint credit balance in the joint credit meter via a first display device of the first electronic gaming machine, and communicate data that results in a display of the joint credit balance in the joint credit meter via a second display device of the second electronic gaming machine. The plurality of instructions, when executed by the processor, further cause the processor to communicate data that results in a first credit amount equal to a zero balance to be displayed via a first individual credit meter of the first display device of the first electronic gaming machine, and communicate data that results in a second credit amount equal to a zero balance to be displayed via a second individual credit meter of the second display device of the second electronic gaming machine.

Additional features are described in, and will be apparent from, the following Detailed Description and the figures.

DETAILED DESCRIPTION

EGMs with Shareable Joint Credit Meters

Figure 1A:
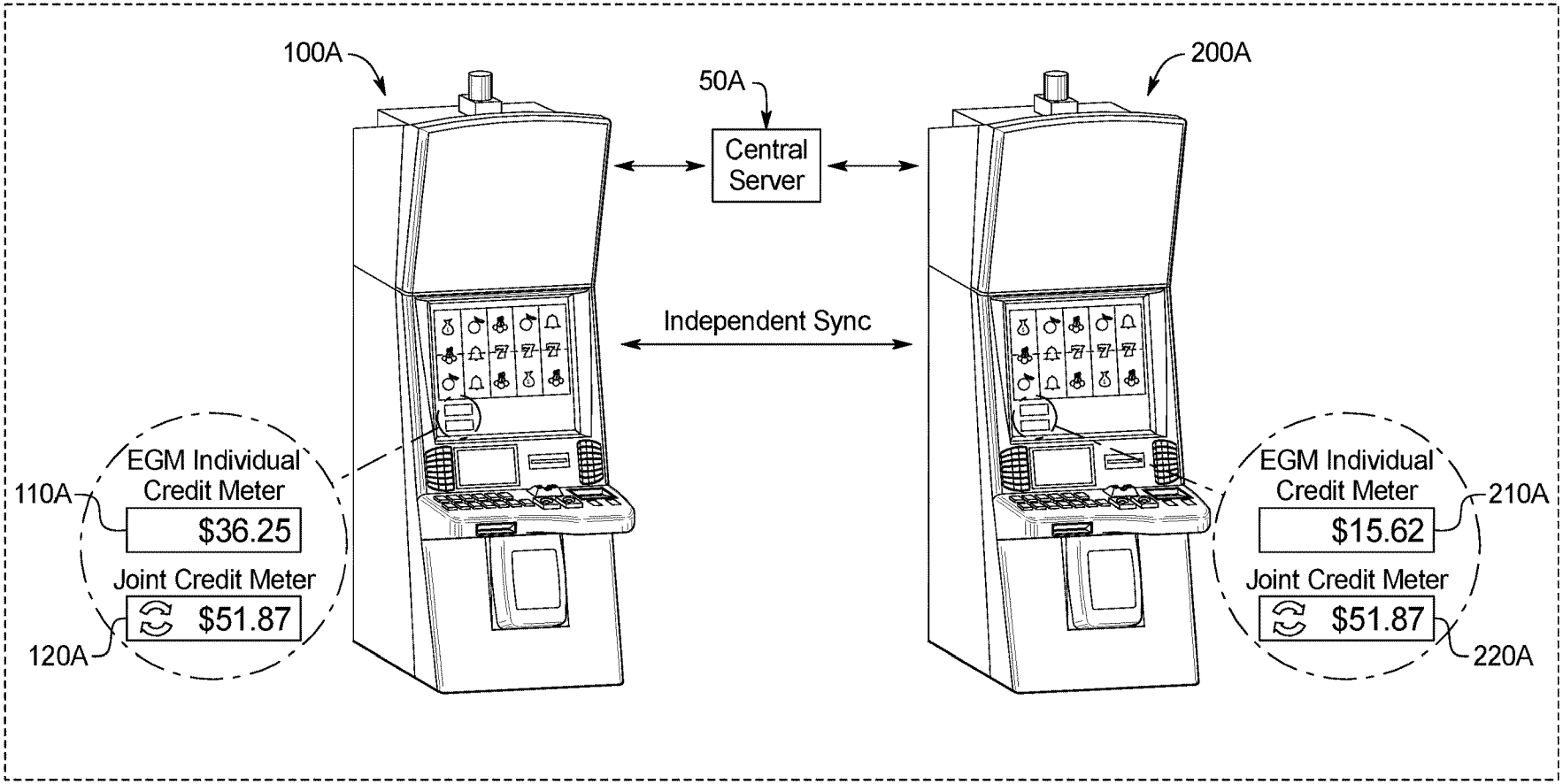
FIG. 1A is a diagrammatic view of two EGMs and associated credit meters of a first example embodiment of a gaming system of the present disclosure, wherein the respective credit meters of the EGMs are enlarged for clarity.

In various embodiments, the present disclosure relates to gaming systems and methods that enable multiple players to share a credit balance displayed by joint credit meters. More specifically, in various embodiments, the gaming system and method enables multiple players to share a joint credit balance to separately play wagering games of two or more separate electronic gaming machines ("EGMs") of the gaming system. The gaming system enables each of the players to use and thus share the credits of the credit balance displayed by the joint credit meters to sequentially, simultaneously, or partially simultaneously (e.g., overlapping) play one or more wagering games at the respective EGMs of the gaming system.

In the various example embodiments of the present disclosure described below, two EGMs, one joint credit balance, and two joint credit meters (i.e., one displayed by each of the EGMs) are used to explain the present disclosure. However, it should be appreciated that the present disclosure is not limited to providing only one joint credit balance or only two joint credit meters for only two EGMs, that the quantity of EGMs that share a joint credit balance may vary in accordance with the present disclosure, and that the quantity of EGMs and the quantity of joint credit meters may vary in accordance with the present disclosure.

In the various example embodiments of the present disclosure described below, the joint credit meter is displayed by each of the EGMs that share the joint credit balance maintained by the gaming system, and thus the joint credit meters of the EGMs that display the joint credit balance are given separate reference numerals herein for ease of description. However, it should be appreciated that in various embodiments the joint credit meters (displayed by the EGMs of the system) function as a single credit meter. It should also be appreciated that in various embodiments of the present disclosure a central server of the gaming system operates with the EGMs of the gaming system to send to and receive data from the EGMs regarding the amounts of credits on each of the individual credit meters of the EGMs and on each of the joint credit meters displayed by the EGMs. As indicated below, the central server operates to sync the joint credit meters displayed by the EGMs such that at any one point in time, each of the joint credit meters displays the same sharable joint credit balance.

In the various example embodiments of the present disclosure and as further discussed below, the gaming system provides one or more verification procedures that enable two or more players to use the separate EGMs and to share one or more joint credit balances. In various embodiments, the gaming system requires each player to be validated. The players may be validated in any suitable manner such as but not limited to by a player identification or player tracking system (such as for so-called carded players).

In the various example embodiments of the present disclosure described below, the gaming system includes EGMs that enable wagering games such as slot or card wagering games. It should be appreciated that the gaming system can be employed with other types of EGMs or other devices (such as kiosks or mobile devices) that provide various types of wagering (such as sports related wagering). It should also be appreciated that the gaming system of the present disclosure can be employed with EGMs of different types and are thus can be game type agnostic.

In a first example embodiment shown in FIG. 1A, the gaming system includes a central server 50A and a plurality of EGMs such as two separate EGMs 100A and 200A. These EGMs (such as but not limited to the EGMs described below) are configured to communicate with the central server 50A. This example embodiment is referred to as the "Independent Sync" embodiment. In this example embodiment, each EGM has an individual credit meter and a joint credit meter both displayed by one or more display devices of that EGM. In FIG. 1A, these credit meters are shown enlarged adjacent to the respective EGM for clear illustration and explanation purposes only. In FIG. 1A, EGM 100A displays the individual credit meter 110A and the joint credit meter 120A. In FIG. 1A, EGM 200A displays the individual credit meter 210A and the joint credit meter 220A.

In this example embodiment, the individual credit meter 110A (of EGM 100A) and the individual credit meter 210A (of EGM 200A) are separate from each other and are respectively controlled by the EGMs 100A and 200A as described herein. The EGMs 100A and 200A are each configured to communicate data to the central server 50A, and particularly data regarding the credit balances maintained by the EGMs 100A and 200A (as those balances change). The EGMs 100A and 200A are also configured to receive data from the central server 50A, and particularly data regarding transfers of credits between the EGMs 100A and 200A or the individual credit balances maintained by the EGMs 100A and 200A.

In the example embodiment of FIG. 1A, the gaming system initiates a credit sync session for the EGM's 100A and 200A through the central server 50A of the gaming system. It should be appreciated that the credit sync session may be initiated in any suitable manner. For example, either EGM may be configured to enable a player at that EGM to initiate a credit sync session with another EGM via the central server. In another example, the gaming system, may initiate a credit sync session with two or more EGMs based on one or more predefined rules or triggering events.

After a credit sync session is initiated, in this example embodiment of FIG. 1A, the gaming system and specifically the central server 50A is configured to cause the joint credit meter 120A displayed by EGM 100A and the joint credit meter 220A displayed by EGM 200A to display the same amount of credits as illustrated in FIG. 1A. In other words, in this Independent Sync embodiment, the central server 50A receives data from each of the EGMs 100A and 200A regarding the amount of credits on the respective individual EGM credits meter 110A and 210A and causes the joint credit meters 120A and 220A to display the joint credit balance (as regularly updated) based on those respective amounts. In this example embodiment, the gaming system is configured to cause the joint credit meters shown by each of the EGMs to include the sum of the respective amounts of the individual credit meter 110A (of EGM 100A) and the individual credit meter 210A (of EGM 200A).

For example, as shown in FIG. 1A, the individual credit meter 110A (of EGM 100A) shows an individual balance of $36.25, the individual credit meter 210A (of EGM 200A) shows an individual balance of $15.62, and the joint credit meters 120A and 220A each show a joint credit balance of $51.87 that is the sum of the amounts shown in the respective individual credit meters of these EGMs at this point in time. It should be appreciated that in this illustrated example embodiment, all of the credit meters display the amounts in dollars and cents. In other example embodiments, the credits meters display the amounts in credits for a suitable denomination or otherwise. These amounts, regardless of the manner in which they are displayed, are referred to herein as credits.

In this example embodiment of FIG. 1A, during the credit sync session, the central server 50A is configured to: (1) receive first credit data regarding a first credit amount displayed via the individual credit meter 110A of the first EGM 100A; (2) receive second credit data regarding a second credit amount displayed via the individual credit meter 210A of the second EGM 200A; and (3) maintain, for the joint credit meters 120A and 220A, a joint credit balance including the first credit amount and the second credit amount. In this example embodiment, during the credit sync session, the central server 50A is configured to: (1) communicate data to the first EGM 100A that results in the first EGM 100A displaying the joint credit balance in the joint credit meter 120A; and (2) communicate data to the second EGM 200A that results in the second EGM 200A displaying the joint credit balance in the joint credit meter 220A. The central server 50A is configured to regularly receive this individual credit meter data from the EGMs and regularly send this joint credit meter data to the EGMs. In this example embodiment, during the credit sync session, on a regular basis, responsive to a change of one of the first credit amount and the second credit amount, the central server 50A causes a corresponding change to the joint credit balance, communicates data that results in the first EGM 100A displaying the changed joint credit balance in the joint credit meter 120A, and communicates data that results in the second EGM 200A displaying the changed joint credit balance in the joint credit meter 220A. It should be appreciated that the regular basis can be at any suitable intervals (such as once every 1/10 of a second) such that it appears to players to be on a continuous or real time basis.

In this example embodiment, during the credit sync session, the change to one of the first credit amount and the second credit amount can include any one or more of: a wager amount deducted from the first individual credit meter for a play of a first wagering game of the first EGM, a wager amount deducted from the second individual credit meter for a play of a second wagering game of the second EGM, an amount added to the first individual credit meter from a play of the first wagering game (including any bonus game), an amount added to the second individual credit meter from a play of the second wagering game (including any bonus game), a cash-out of the first individual credit meter, a cash-out of the second individual credit meter, a player deposit of a first amount of funds to the first individual credit meter, and a player deposit of a second amount of funds to the second individual credit meter.

In this example embodiment, during the credit sync session, the central server, responsive to an occurrence of a credit transfer triggering event, causes a transfer of credits from the first individual credit meter to the second individual credit meter without causing a change to the joint credit meter, or causes a transfer of credits from the second individual credit meter to the first individual credit meter without causing a change to the joint credit meter. In this example embodiment, during the credit sync session, the credit transfer triggering event can include any suitable event or set of events. It should be appreciated that the credit transfer triggering event can include the occurrence of one or more predefined conditions. Various example credit triggering events and example transfers are described herein; however, it should be appreciated that such examples are not meant to limit the present disclosure.

In one such example, the credit transfer triggering event can include one or more of: the first individual credit meter reaching a first designated credit level and the second individual credit meter reaching a second designated credit level. In this example embodiment, during the credit sync session, the credit transfer condition is based on an amount of one of the first individual credit meter and/or and the second individual credit meter. In one such example embodiment, the gaming system is configured to, responsive to the individual credit meter of a first one of the EGMs reaching (or decreasing below) a defined minimum credit threshold (such as zero), and responsive to the individual credit meter of the second one of the EGMs being at or above a defined credit transfer allowance threshold (such as 1,000 credits), cause a transfer of a designated quantity of the credits (such as 100 credits) from the second EGM to the first EGM.

In another such example embodiment, during the credit sync session, the credit transfer triggering event includes one or more of: a first input received via a first input device of the first EGM, and a second input received via a second input device of the second EGM. In this example embodiment, during the credit sync session, the central server receives from the first EGM, data associated with a player input associated with a credit transfer condition for causing a credit transfer between the first individual credit meter of the first EGM and the second individual credit meter of the second EGM.

In another such example embodiment, responsive to a player of the second EGM initiating a wager (such as a payline selection and amount of credits wagered on that payline) and the second EGM not having enough credits in the second individual credit meter of the second EGM, the gaming system queues the first EGM for a balance of the individual credit meter of that first EGM. Response to the credit meter of that first EGM being at or above the credit transfer allowance threshold, the gaming system causes a transfer of credits (such as by a WAT, EFT, or AFT) from the first EGM to the second EGM. The transfer amount can be any suitable amount such as but not limited to: (1) an amount of credits equal to that wager amount; (2) an amount of credits equal to a designated percentage of the credits on the individual credit meter of the first EGM; (3) an amount of credits equal to a predefined amount of money; or (4) an amount of credits equal to a predefined amount of credits. In various embodiments, the predefined transfer amount is a preset amount based in part on the denomination of the EGM (that is casino configurable to limit the network traffic to the central server). For example, the predefined transfer amount can be: (a) $50 for a $10 denomination EGM; (b) $25 for a $5 denomination EGM; or (c) $10 for a $1 denomination EGM. The credit transfer enables the initiated wager by the player of the second EGM to be made.

In various of these example embodiments, the gaming system can be configured to: (1) automatically make such transfer after the occurrence of the triggering event; (2) make such transfer after approval by one of the players of the EGM (such as the EGM transferring the credits) after the occurrence of the credit transfer triggering event; or (3) make such transfer after approval by both of the players of the EGMs after the occurrence of the credit transfer triggering event. The gaming system can be configured to make the transfer or not make the transfer based on one or more other suitable conditions or rules.

In this example embodiment, each of the EGMs retains their respective individual credit meter balances until a cash-out event occurs for that EGM. In this example embodiment, responsive to a cash-out event occurring for that EGM, the EGM facilitates a cash-out of the individual credit meter balance for that EGM. In other example embodiments, the gaming system facilitates a final system transfer, if needed, to facilitate a split of the credit balance such as a split and cash-out of the joint credit balance (such as on a 50-50 basis).

In certain embodiments, responsive to and after the cash-out for one or more of the EGMs, in this example embodiment, the gaming system terminates the credit sync session for the EGMs. In certain embodiments, responsive to and after a player cards out or logs out, the gaming system terminates the credit sync session for the EGMs as further discussed below.

In various alternative example embodiments, during the credit sync session, the gaming system maintains the joint credit balance in an account maintained by a gaming establishment fund management system.

Figure 1B:
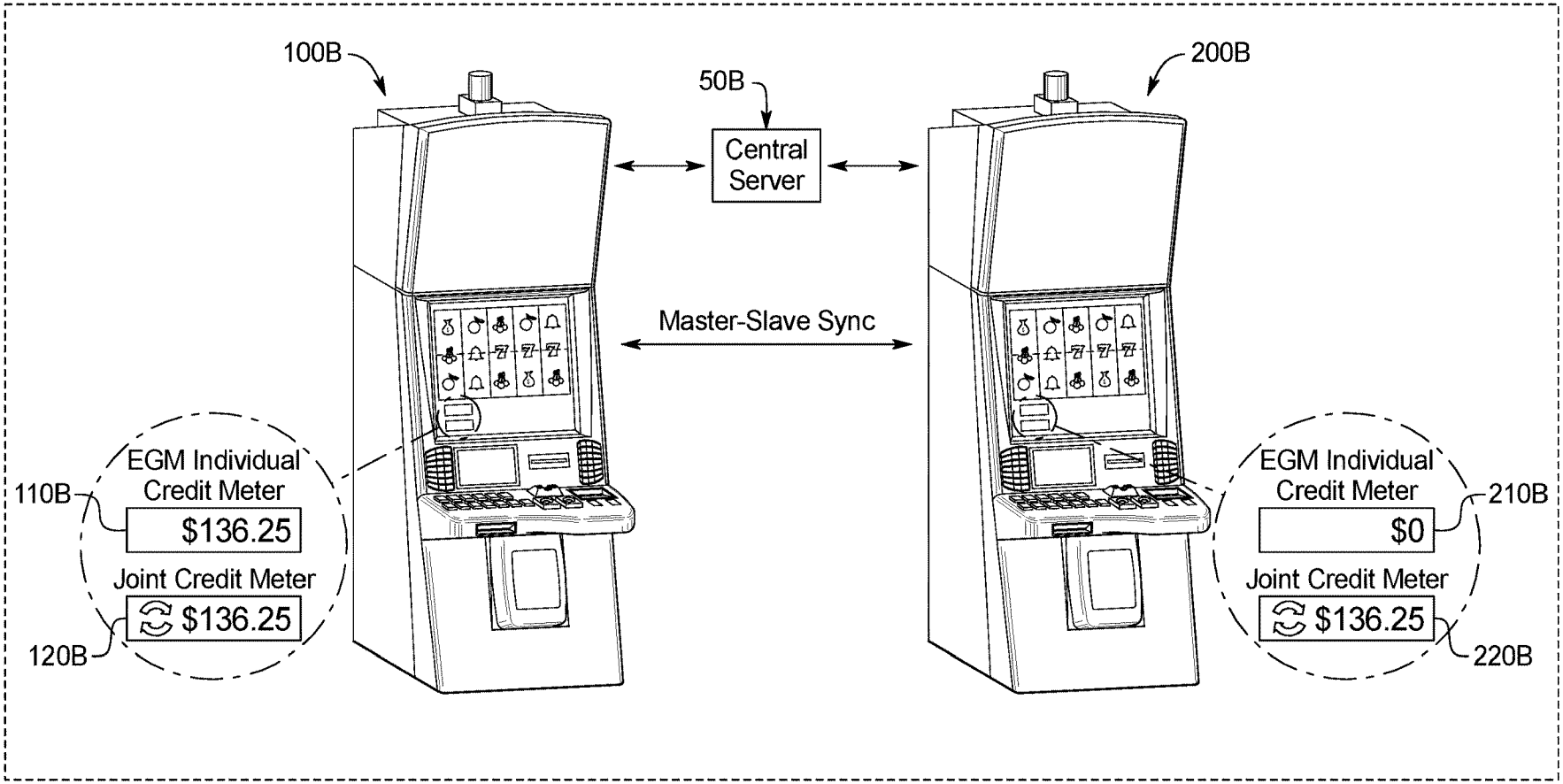
FIG. 1B is a diagrammatic view of two EGMs and associated credit meters of a second example embodiment of a gaming system of the present disclosure, wherein the respective credit meters of the EGMs are enlarged for clarity.

In a second example embodiment shown in FIG. 1B, the gaming system includes a central server 50B and a plurality of separate EGMs such as two separate EGMs 100B and 200B. These EGMs (such as but not limited to the EGMs described below) are configured to communicate with the central server 50B such as described above and below. In this example embodiment, each EGM has an individual credit meter and a joint credit meter displayed by one or more display devices of that EGM. In FIG. 1B, these credit meters are shown enlarged adjacent to the EGMs for clear illustration and explanation purposes only. In FIG. 1B, EGM 100B has an individual credit meter 110B and a joint credit meter 120B. In FIG. 1B, EGM 200B has an individual credit meter 210B and a joint credit meter 220B.

This example embodiment is referred to as the "Master-Slave Sync" embodiment. Generally, in this example, one of the EGMs such as EGM 100B maintains the entire individual credit balance and the other EGMs such as EGM 200B uses that credit balance on a regular basis for wagering activity. In this example embodiment, the respective individual credit meter 110B (of EGM 100B) and the individual credit meter 210B (of EGM 200B) are respectively controlled by the EGMs 100B and 200B and/or the central server 50B.

In this example embodiment, the gaming system initiates a credit sync session for the EGM's 100B and 200B through the central server 50B of the gaming system. It should be appreciated that the credit sync session may be initiated in any suitable manner (such as described above and below).

After a credit sync session is initiated, in this example embodiment, the gaming system and specifically the central server 50B is configured to cause the joint credit meter 110B displayed by EGM 100B and the joint credit meter 210B displayed by EGM 200B to regularly show the same amount of credits (as shown in FIG. 1B) in a similar manner to the manner described above.

In this Master-Slave Sync embodiment, the central server receives data from the EGM 100B regarding the amount of credits on the individual credit meter 110B and causes each of the joint credit meters 120B and 220B to display regular updates based on that amount. In this example embodiment, the gaming system is configured to cause the joint credit meters shown by each of the EGMs to display a joint credit balance amount equal to the individual credit meter 110B of EGM 100B. In this example embodiment, gaming system including the central server 50B and the EGM 200B are configured to cause the individual credit meter 210B of EGM 200B to remain at zero throughout the credit sync session.

For example, as shown in FIG. 1B, the individual credit meter 110B of EGM 100B shows a balance of $136.25, the individual credit meter 210B of EGM 200B shows a balance of $0, and the joint credit meters 120B and 220B each show a balance of $136.25—that is equal to the amount shown in the individual credit meter 110B. It should be appreciated that in this illustrated example embodiment, the credit meters display the amounts thereon in dollars and cents. In other example embodiments, the credits meters display the amounts in credits for a suitable denomination or otherwise. In this example embodiment, the EGM 100B is the master EGM and the credit meter 110B shown by the EGM 100B includes the total credits for both EGMs 100B and 200B.

In this example embodiment, during the credit sync session, the central server 50B is configured to: (1) maintain the joint credit balance for the joint credit meters 120B and 220B for the respective EGMs 100B and 200B; (2) communicate data to EGM 100B that results in a display of the joint credit balance in the joint credit meter 120B by EGM 100B; (3) communicate data to EGM 200B that results in a display of the joint credit balance in the joint credit meter 220B by EGM 200B; (4) communicate data to the EGM 100B that results in a first credit amount equal to the joint credit balance being displayed via the individual credit meter 110B by EGM 100B; and (5) communicate data that results in a second credit amount equal to a zero balance to be displayed via the second individual credit meter 210B of the second EGM 220B. The central server 50B is thus configured to regularly receive credit data from these EGMs and regularly send credit data to these EGMs.

In the example embodiment of FIG. 1B, during the credit sync session, a change to the respective credit amount can include any one or more of: a wager amount deducted for a play of a first wagering game of the first EGM, a wager amount deducted for a play of a second wagering game of the second EGM, an amount added from a play of the first wagering game, an amount added from a play of the second wagering game, a cash-out from the first EGM, a player deposit of a first amount of funds to the first EGM, and a player deposit of a second amount of funds to the second EGM. It should be appreciated that the gaming system of this example embodiment can be configured to handle such changes in multiple different ways. Generally, one example way is for any such amounts to be first accounted for (i.e., go to or be taken from) by the joint credit meters and then to the EGM credit meter(s). Generally, another example way is for any such amounts to first be accounted for (i.e., go to or be taken from) by the master individual credit meter and then to the joint credit meters.

More specifically, in various example embodiments, during the credit sync session, on a regular basis, responsive to a change to the first credit amount in the first credit meter 110B, the central server 50B causes a corresponding change to the joint credit balance, communicates data that results in the first EGM 100B displaying the changed joint credit balance in the joint credit meter 120B, and communicates data that results in the second EGM 200B displaying the changed joint credit balance in the joint credit meter 220B. It should be appreciated that the regular basis can be at such suitable intervals that it appears to players to be on a continuous or real time basis.

In various example embodiments, during the credit sync session, all credits for playing wagering games and credits won from playing wagering games (including any bonus games) of the second EGM 200B are from and to the joint credit meter 220B. In this example, (1) the joint credit meter 120B is changed based on such change to the joint credit meter 220B; and (2) the individual credit meter 110B is changed based on such change to the joint credit meter 120B.

In various example embodiments, during the credit sync session, all credits for playing wagering games and credits won from playing wagering games (including any bonus games) of the second EGM 200B are from and to the individual credit meter 110B. In this example, (1) the joint credit meter 120B is changed based on such change to the individual credit meter 110B; and (2) the joint credit meter 220B is changed based on such change to the joint credit meter 120B.

In various example embodiments, during the credit sync session, all credits for playing wagering games and credits won from player wagering games (including any bonus games) of the first EGM 100B are from and to the individual credit meter 110B. In this example: (1) the joint credit meter 120B is changed based on such change to the individual credit meter 110B; and (2) the joint credit meter 220B is changed based on such change to the joint credit meter 120B.

In various example embodiments, during the credit sync session, all credits for playing wagering games and credits won from player wagering games (including any bonus games) of the first EGM 100B are from and to the joint credit meter 120B. In this example: (1) the individual credit meter 1106 is then changed based on such change to the joint credit meter 120B; and (2) the joint credit meter 220B is changed based on such change to the joint credit meter 120B.

In various example embodiments, during the credit sync session, the central server, responsive to an occurrence of a credit transfer triggering event, causes a transfer of credits from the first EGM 1006 to the second EGM 200B for wagering purposes.

In various such example embodiments, during the credit sync session, the credit transfer triggering event includes one or more of: an input received via a second input device of the second EGM. For example, responsive to a player at the second EGM initiating a wager (such as a payline selection and amount of credits on that payline), the gaming system request an amount via the joint credit meter and uses that amount for the wager. In various of these example embodiments, the gaming system can be configured in any suitable manner to approve and make such transfer such as but not limited to: (1) automatically making such transfer after the occurrence of the credit transfer triggering event; (2) making such transfer after approval by the player of the master first EGM; or (3) making such transfer if such request meets one or more conditions (such as one or more balance level conditions).

In various example embodiments, responsive to any amount won at the second EGM, the gaming system causes that amount to be transferred to the master first EGM such as described above. In various of these example embodiments, the gaming system can be configured can be configured in any suitable manner to approve and make such transfer such as but not limited to automatically making such transfer after the occurrence of the such winning event.

In various example embodiments, the first EGM 100B retains the individual credit meter balance until a cash-out event occurs for that EGM 1006. In this example embodiment, responsive to a cash-out event occurring for that EGM 1006, the EGM 100B facilitates the cash-out of the credit balance on the individual credit meter 1106 for that EGM 1006. In certain of these example embodiments, the second EGM 200B cannot facilitate a cash-out event.

In various example embodiments, responsive to the cash-out for the first EGM 1006, the gaming system terminates the credit sync session for the EGM and provides the entire credit balance to the player of the first EGM.

In various example embodiments, responsive to the cash-out for the first EGM 1006, the gaming system terminates the credit sync session for the EGM and provides a split of the credit balance between the players of the first EGM 100B and the second EGM 200B. This split can be any suitable split—such as an equal split.

In various example embodiments, responsive to receiving such cash-out request, the gaming system can cause a message to be displayed by both EGM that indicates that the cash-out is occurring and that the gaming system is preventing any new wagers on either EGM.

In various example embodiments, responsive to a cash-out for the second EGM 200B, the gaming system terminates the credit sync session for that EGM 200B, but continues to enable the player of the first EGM 1006 to use the credit balance on the individual credit meter 1106 of the first EGM 1006.

In various example embodiments, during the credit sync session, the gaming system maintains the joint credit balance in an account maintained by a gaming establishment fund management system.

In a third example embodiment shown in FIG. 10, the gaming system includes a central server 50C and a plurality of EGMs such as two separate EGMs 100C and 200C. These EGMs (such as but not limited to the EGMs described below) are configured to communicate with the central server 50C. This example embodiment is referred to as the "Wallet Sync #1" embodiment. In this example embodiment, each EGM has an individual credit meter and a joint credit meter displayed by one or more display devices of that EGM. In FIG. 10, these credit meters are enlarged and shown adjacent to the respective EGM for clear illustration and explanation purposes only. In FIG. 10, EGM 100C has an individual credit meter 110C and a joint credit meter 120C. In FIG. 10, EGM 200C has an individual credit meter 210C and a joint credit meter 220C.

In this example embodiment, during the credit sync session, the gaming system maintains the joint credit balance in an account maintained by a gaming establishment fund management system (such as a mobile wallet account or a system wallet account) and displays that joint credit balance to the players of the EGMs 100C and 200C in the joint credit meters 120C and 220C.

In this example embodiment, the individual credit meter 110C of EGM 100C and the individual credit meter 2100 of EGM 200C are separate from each other and are respectively controlled by the EGMs 100C and 200C or are controlled by the central server 50C.

In this example embodiment, the gaming system initiates a credit sync session for the EGM's 100C and 200C through the central server 50C of the gaming system. It should be appreciated that the credit sync session may be initiated in any suitable manner such as the manners described above and below.

After a credit sync session is initiated, in this example embodiment, the gaming system and specifically the central server 50C is configured to cause the joint credit meter 120C displayed by EGM 100C and the joint credit meter 220C displayed by EGM 200B to regularly show the same amount of credits (as shown in FIG. 10). In other words, in this Wallet Sync 1 embodiment, like the above embodiments, the central server 50C receives data from each of the EGMs 100C and 200C regarding the amount of credits wagered and won on those respective individual EGMs 100C and 200C and causes the joint credit meters 120C and 220C to display regular updates based on those respective amounts. However, in this example embodiment, the individual credit meters 110C and 210C are each maintained at zero and all management of the credit balances is through the joint credit meters 120C and 220C and the central server 50C.

For example, as shown in FIG. 10, the individual credit meter 110C of EGM 100C shows $0, the individual credit meter 2100 of EGM 200C shows $0, and the joint credit meters 120C and 220C each show $522.00 that is the amount of the joint credit balance at this point in time. It should be appreciated that in this illustrated example embodiment, the credit meters display the amounts thereon in dollars and cents, but could display these amounts in other suitable manners.

In this example embodiment, during the credit sync session, the central server 50C is configured to: (1) cause a joint account maintained by a gaming establishment fund management system to maintain a joint credit balance for the joint credit meters of the first and second EGMs; (2) communicate data to the first EGM that results in a display of the joint credit balance in the joint credit meter of the first EGM; and (3) communicate data to the second EGM that results in a display of the joint credit balance in the joint credit meter of the second EGM. In this example embodiment, during the credit sync session, the central server 50C may also be configured to: (4) communicate data to the first EGM that results in a first credit amount equal to a zero balance to be displayed by the first individual credit meter of the first EGM; and (5) communicate data to the second EGM that results in a second credit amount equal to a zero balance to be displayed by the second individual credit meter of the second EGM.

In this example embodiment, during the credit sync session, the central server 50C is configured to, responsive to a change of the joint credit balance: (1) communicate data to the first EGM that results in the first EGM displaying the changed joint credit balance in the joint credit meter of that EGM; and (2) communicate data to the second EGM that results in the second EGM displaying the changed joint credit balance in the joint credit meter of that EGM.

In this example embodiment, a change to the joint credit balance can include, for example, any one of: a wager amount deducted from the joint credit meter for a play of a first wagering game of the first EGM, a wager amount deducted from the joint credit meter for a play of a second wagering game of the second EGM, an amount added to the joint credit meter from a play of the first wagering game, and an amount added to the joint credit meter from a play of the second wagering game.

In this example embodiment, responsive to either player at either EGM initiating a wager (such as a payline selection and amount of credits on that payline), the gaming system employs the joint credit balance for such wager. In various such embodiments, responsive to such initiation of the wager, the central server 50 obtains the amount of the wager (such as by a WAT, EFT, or AFT) from the joint credit balance stored in the gaming establishment fund management system. In various of these example embodiments, the gaming system can be configured to automatically make such transfer provided that enough funds are in such joint credit balance. In other embodiments, the gaming system can be configured to make such transfer subject to one or more conditions or rules. In this example embodiment, after such transfer is made and such wager is placed, the central server 50C causes the joint credit meters 120C and 220C to each display a reduced amount based on the amount of that wager.

In this example embodiment, responsive to either player at either EGM winning an amount, the gaming system adds that amount back to the joint credit balance. In various such embodiments, the central server 50 causes that amount to be transferred to the joint credit balance stored in the gaming establishment fund management system. In various of these example embodiments, the gaming system can be configured to automatically make such transfer. In other embodiments, the gaming system can be configured to make such transfer subject to one or more conditions or rules. In this example embodiment, after such transfer is made and such wager is placed, the central server 50C causes the joint credit meters 120C and 220C to each display an increased amount based on the amount won.

In this example embodiment, responsive to and after the cash-out for one or more of the EGMs, in this example embodiment, the gaming system terminates the credit sync session for the EGMs and the joint credit balance remains in the gaming establishment fund management system.

In other example embodiments, responsive to and after the cash-out for one or more of the EGMs, the gaming system terminates the credit sync session for the EGMs and transfers the joint credit balance to one of the EGMs or splits that joint credit balance between the two EGMs. In various such embodiments, each EGM(s) places that received amount on the individual credit balance of that EGM and then enables the player of that EGM to cash-out that amount.

In other example embodiments, responsive to and after a partial cash-out for one or more of the EGMs, the gaming system transfers the requested part of the joint credit balance to one of the EGMs or slits that requested joint credit balance between the two EGMs to facilitate the cash-out.

Figure 1C:
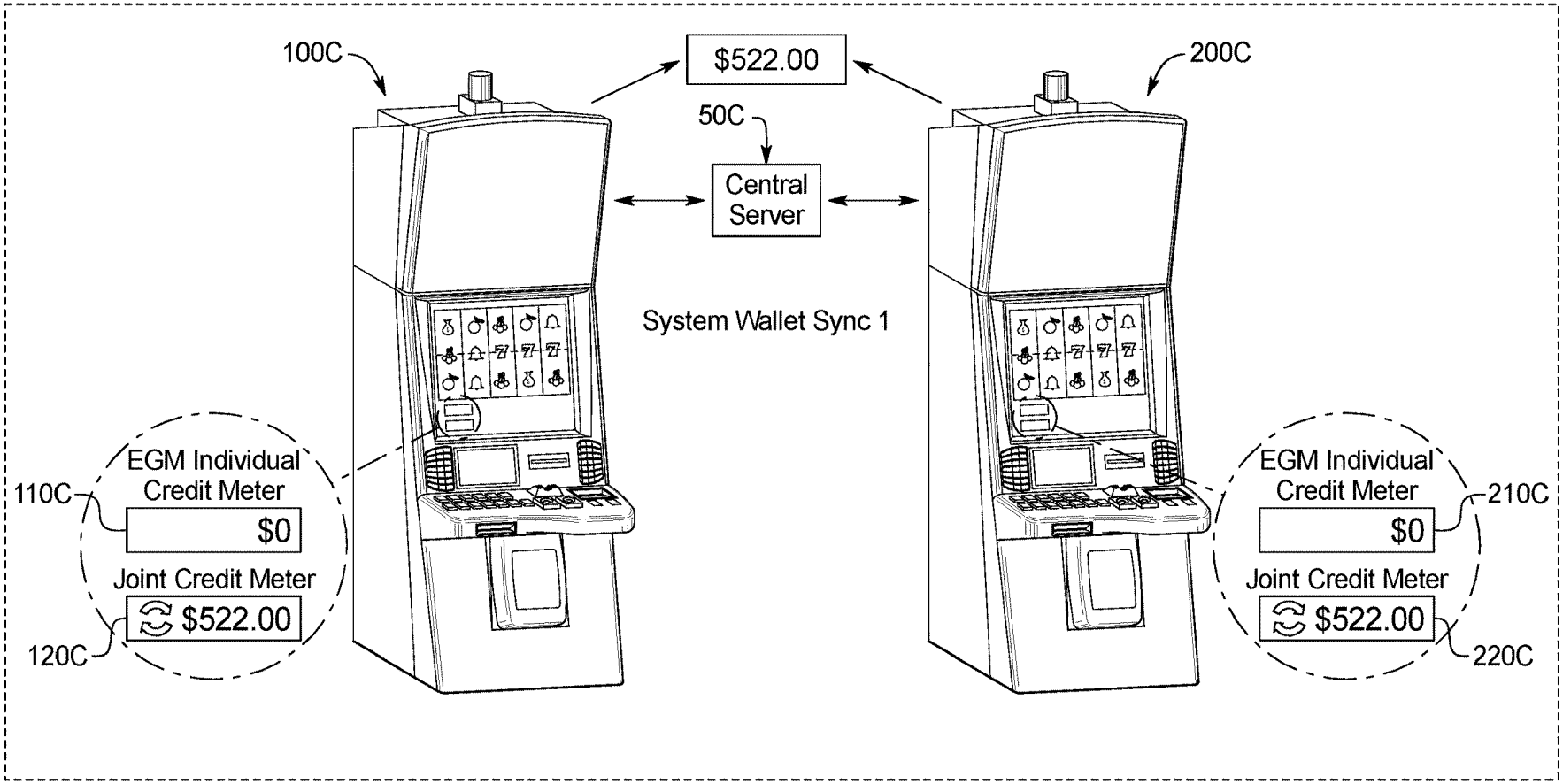
FIG. 1C is a diagrammatic view of two EGMs and associated credit meters of a third example embodiment of a gaming system of the present disclosure, wherein the respective credit meters of the EGMs are enlarged for clarity.
Figure 1D:
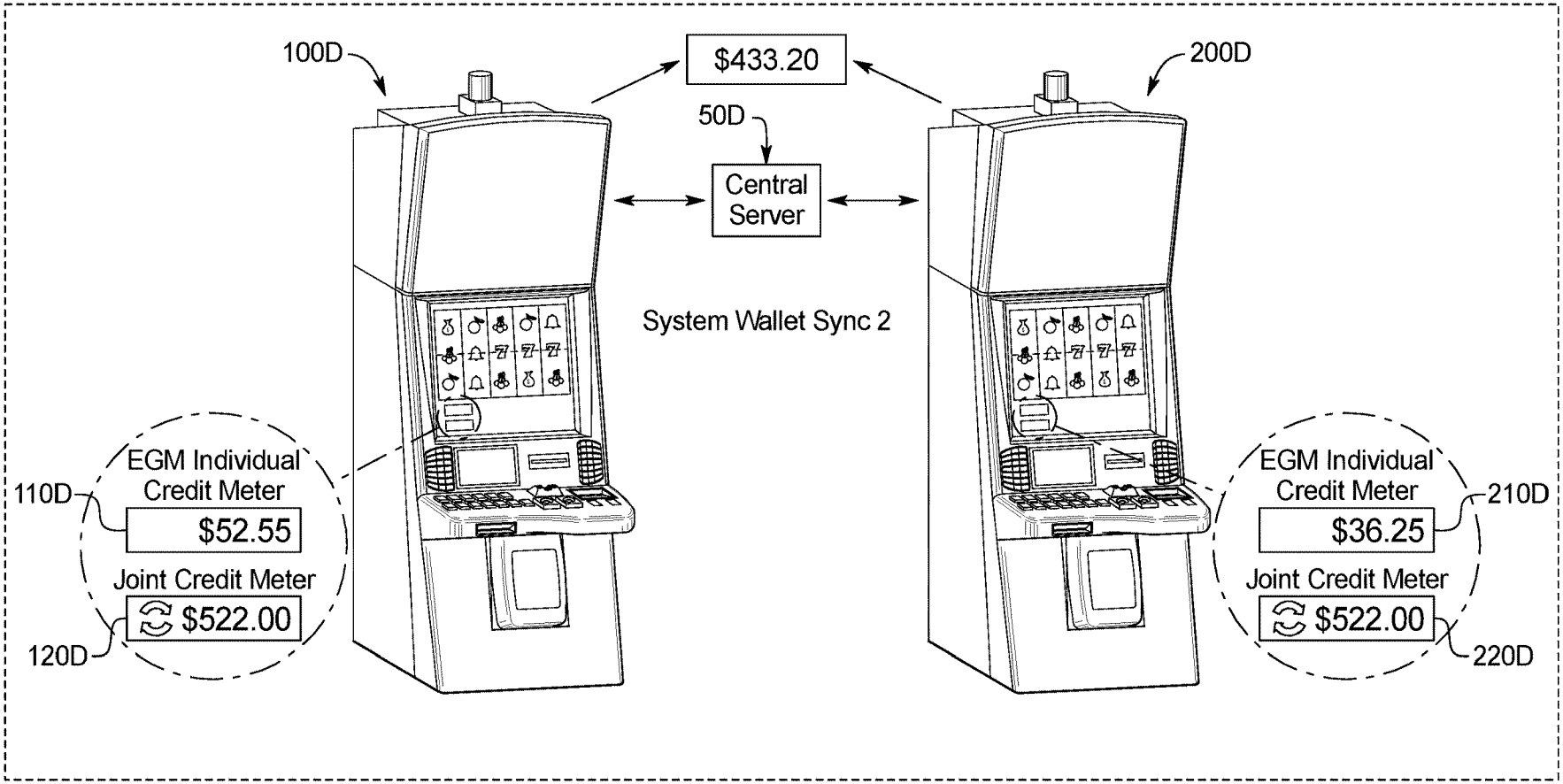
FIG. 1D is a diagrammatic view of two EGMs and associated credit meters of a fourth example embodiment of a gaming system of the present disclosure, wherein the respective credit meters of the EGMs are enlarged for clarity.

In a fourth example embodiment shown in FIG. 1D the gaming system includes a central server 50D and a plurality EGMs such as two separate EGMs 100D and 200D. The EGMs 100D and 200D (such as but not limited to the EGMs described below) are configured to communicate with the central server 50D. This example embodiment is referred to as the "Wallet Sync #2" embodiment. In this example embodiment, each EGM has an individual credit meter and a joint credit meter displayed by one or more of the display devices of that EGM. In FIG. 1D, these credit meters are also shown enlarged adjacent to the EGMs for clear illustration and explanation purposes only. In FIG. 1D, EGM 100D has an individual credit meter 110D and a joint credit meter 120D. In FIG. 1D, EGM 200D has an individual credit meter 210D and a joint credit meter 220D.

In this example embodiment, the individual credit meter 110D of EGM 100D and the individual credit meter 210D of EGM 200D are separate from each other and are respectively controlled by the EGMs 100D and 200D as described herein. The EGMs 100D and 200D are configured to communicate data to the central server 50D, and particularly the individual credit balances maintained by the EGMs 100D and 200D (as those balances change). The EGMs 100D and 200D are also configured to receive data from the central server 50D.

In the example embodiment of FIG. 1D, the gaming system initiates a credit sync session for the EGM's 100D and 200D through the central server 50D of the gaming system. It should be appreciated that the credit sync session may be initiated in any suitable manner.

After a credit sync session is initiated, in this example embodiment of FIG. 1D, the gaming system and specifically the central server 50D is configured to cause the joint credit meter 110D displayed by EGM 100D and the joint credit meter 210D displayed by EGM 200D to display the same amount of credits (as illustrated in FIG. 1D).

In other words, in this Wallet Sync II embodiment, the central server 50D receives data from each of the EGMs 100D and 200D regarding the amount of credits on each of the respective individual credits meter 110D and 210D.

The central server 50D combines those amounts with an amount maintained by a gaming establishment fund management system (such as a mobile wallet account or a system wallet account) for one or more of the player(s) of the EGMs, and causes the joint credit meters 110D and 210D to display that amount as the joint credit balance (as regularly updated) based on those respective amounts. In this example embodiment, the gaming system is configured to cause the joint credit meters shown by each of the EGMs to include the sum of the respective amounts of: (1) the individual credit meter 110D of EGM 100D; (2) the individual credit meter 210D of EGM 200D; and (3) an accessible amount in the gaming establishment fund management system that is accessible by one or more of the players.

For example, as shown in FIG. 1D, the individual credit meter 110D of EGM 100D shows an individual balance of $52.55, the individual credit meter 210D of EGM 200D shows an individual balance of $36.25, and the joint credit meters 120D and 220D each show a joint credit balance of $522.00 that includes the amounts shown in the respective individual credit meters of these EGMs and the additional accessible amount in the gaming establishment fund management system. It should be appreciated that in this illustrated example embodiment, all of the credit meters display the amounts in dollars and cents, but could be displayed in other suitable manners.

It should thus be appreciated that the gaming system of this example embodiment operates in certain similar manners to the example gaming system of FIG. 1A, and with certain added functionality as further described below. All of the functionality that this example embodiment employs that are explained above with respect to FIG. 1A will not be described again for brevity.

In this example embodiment of FIG. 1D, during the credit sync session, both of the EGMs 100D and 200D have access to a greater amount of credits than just the sum of the credit balances on the individual credit meters 110D and 120D. Thus, in various example embodiments, the credit transfer triggering event can include a transfer from the respective individual credit meters of these EGMs and/or an additional accessible amount in the gaming establishment fund management system. Likewise, in various example embodiments, the credit transfer triggering event can include a transfer to the respective individual credit meters of these EGMs and/or to the gaming establishment fund management system.

It should thus be appreciated that this example embodiment can provide incremental funds moving to and from a gaming establishment fund management system such as one that provides a mobile or system wallet account.

In this example embodiment, responsive to a credit transfer event (such as but not limited to one of the individual credit meters 110D or 210D of the EGMs 100D or 200D being reduced to an amount (such as zero) that prevents further desired wagering by the player of the EGM), the gaming system is configured to enable a transfer of credits to that individual credit meter. The transfer can be from the individual credit meter of the other EGM (such as like the transfer explained above with respect to FIG. 1A), or can be a transfer from the joint credit balance and thus from the gaming establishment fund management system. The transfer from the gaming establishment fund management system can be by any suitable manner (such as by a WAT, EFT, or AFT transfer). The transfer from the gaming establishment fund management system can be of any suitable amount such as based on a requested amount, based on a initiated wager amount, based on a percentage of the amount in the gaming establishment fund management system, and/or based on a set value. The set value can be any suitable value such as explained above.

As mentioned above, in this example embodiment, the transfer event can alternatively be based on an amount won at one of the EGMs or other requested transfer. In this example embodiment, an amount won can remain on the individual credit meter of the EGM on which that amount was won, or can be transferred to the other individual credit meter of the other EGM, or can be transferred to the gaming establishment fund management system. The amount transferred can be any suitable amount. It should be appreciated that in various embodiments, the amounts won are first placed in the respective individual credit meter and then transferred. It should also be appreciated that in various other embodiments, the amounts won can be first placed in the joint credit meter and then transferred.

It should be appreciated that in this example embodiment, two or more players can use the same gaming establishment fund management system (such as the same wallet). In various embodiments, each of the players has the credentials for the common wallet associated with each player account. This enables multiple players to draw from the same account while having different player accounts and different player loyalty account point balances. In another embodiment, the gaming system enables a first player to grant access to that player's wallet to other players and can revoke the access rights at any time, as further described below.

It should be appreciated that the gaming system of any of the above example embodiments can operate under various rules and conditions such as those further described below.

Figure 2:
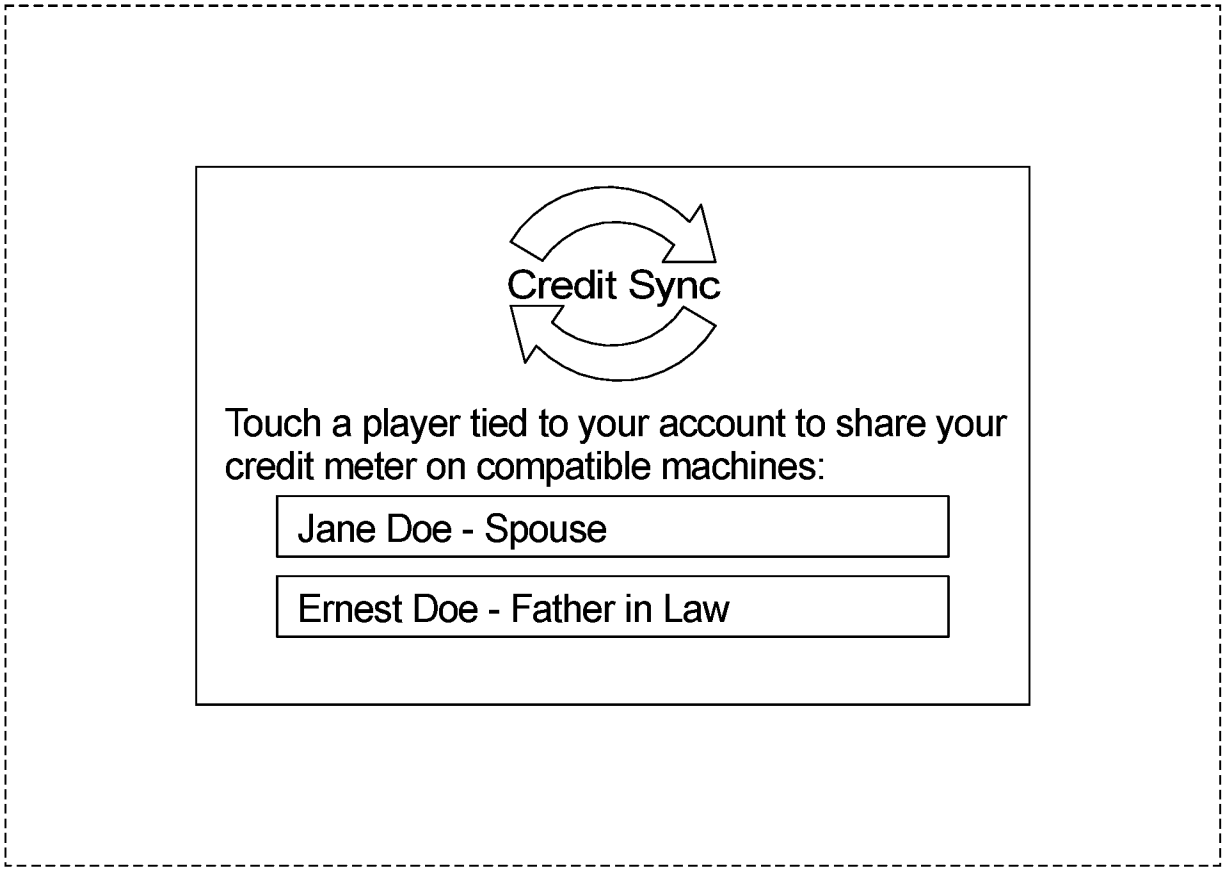
FIG. 2 is screen shot of an example player connection screen of one example embodiment of the present disclosure.

In various embodiments, the gaming system enables and requires a first player to grant permission to one or more other players to use credits of the first player. In various embodiments, the gaming system is configured to enable the first player to revoke the permission at any suitable time. In various embodiments, the gaming system enables the first player to grant the permission by using an interface of the first EGM. FIG. 2 is screen shot of an example player connection screen 500 that enables multiple players at separate EGMs to connect to each other through the gaming system of the present disclosure and facilitates the establishment and sharing of the joint credit balance. It should be appreciated that the player connection screen or other input interface or mechanism can be configured in any suitable manner in accordance with the present disclosure. In various embodiments, the interface enables the first player to see a list of people (such as family and/or friends). In various embodiments, the interface identifies such other players by their player tracking accounts or other suitable identification.

In various embodiments, after granting access, the gaming system prompts the second player to accept the sharing of the credits. In various embodiments, the gaming system enables the first player to grant the permission that includes sending the second person a code such as a one-time-use code. In various such embodiments, the gaming system requires the second player to enter the code though a suitable interface (not shown) and responsive to verification of the code enables the second player to use credits from the first player.

In various embodiments, the gaming system enables the first player to use the first player's mobile device to communicate with the second player's mobile device to provide the permission to transfer credits from the first mobile device to the second mobile device. The gaming system enables the second player to then use their mobile device at a second EGM to gain permission.

It should be appreciated that various embodiments of the present disclosure will employ one or more security features to facilitate use of such mobile devices. For example, various embodiments can require the creation and use of a pin number or passcode for access to such interfaces through such mobile devices.

In various embodiments, the gaming system enables the first player to revoke the permission via a user interface, or to set a timeout of the permission after a certain period via the user interface. In various embodiments, the gaming system automatically revokes the permission after the first player request a cash-out. In various embodiments, the gaming system automatically revokes the permission after the second player requests a cash-out.

In various embodiments, the gaming system automatically revokes the permission after the first player has carded out. In various embodiments, the gaming system automatically revokes the permission after the second player has carded out.

In various embodiments, if the second player already has a balance when accepting the sharing, the gaming system enables the second player to first use the second player's existing credits before sharing the first player's credits.

In various embodiment, if the second player already has a credit balance when accepting the sharing, the gaming system adds the second players balance to the first players balance and begins sharing the common balance from the first player. This can be implemented in various manners such as in accordance with the example gaming system of FIG. 1B described above.

In various embodiments, the gaming system enables the two or more players to share a common balance and each player withdraws from the common balance each time a game is played or a wager is place. This can be implemented in various manners such as in accordance with the example gaming systems of FIG. 1B or 1C described above.

In various embodiments, the gaming system enables the first player to place a time limit on the amount of money that can be transferred to the second player in total or a rate of money that can be transferred (e.g., $40 per hour). The amounts may or may not take into account wins returned from the second player.

In various embodiments, the gaming system enables the first person to set a ratio such that the second player is capped by a certain percentage of the first player's play or balance. For example, the second player could not bet more than the first player or might be limited to 50% of what the first player is wagering.

In various embodiments, the gaming system requires the first player to transfer a specific balance to the second player. For example, the first player might transfer $20 to the second player in one transfer. The gaming system can enable the first player to use an interface to select an amount and a player to which to transfer the money.

In various embodiments, the gaming system enables the first player to choose that if the second player wins, the second player must return: no amount, a portion of the amount transferred, the entire amount transferred, no amount of the win, a portion of the win, or the entire win to the first player's balance. In various embodiments, the gaming system can enable the second player to agree to share the such amounts with the first player. In various embodiments, the gaming system enables one or more of the players to make exceptions to any sharing rules (such as for a Royal Flush win by the second player).

In various embodiments, the gaming system causes the winnings of all players on the EGMs to go to the joint credit meter.

In various embodiment, the gaming system causes the winnings of each player to remain on the individual credit meter of the EGM that the winning occurred on.

In various embodiments, responsive to the second player initiating a cash-out or logging out of the player tracking system, the gaming system can return a transferred balance on the second EGM to the first EGM.

In various embodiments, the gaming system enables one or more of the players to choose a configuration on how and when balances are transferred.

In various embodiments, the gaming system is configured to provide player points using a player tracking system based on the plays of the wagering games of the respective EGMs. In other embodiments, the gaming system can cause a transfer or splitting of the player tracking points based on the joint credit balance sharing or otherwise.

In various embodiments, besides the joint credit meter changing to indicate wagering activity and wins by the other player at the other EGM, the gaming system can be configured to cause the EGMs to display information regarding such occurrences at the other EGMs of the system. For example, if the second player at the second EGM wins $500, and that adds to the joint credit meter, the gaming system can cause a display device of the first EGM to display a notice such as "Player 2 just won $500!".

In various embodiments, the gaming system is configured to provide additional information regarding the play or player at another EGM such as but not limited to pictures or a video of the other player(s) and/or of the game play at the other EGM. This enables the linked player to see what is happening at the other EGM (such as seeing who is winning and what they are winning).

In various embodiments, the gaming system is configured to provide one or more reports or other information regarding any balance sharing to the casino operator and/or one or more of the players. For example, the summary may show how much each player won, transferred, and/or also shows totals for the group.

In various embodiments, the gaming system enables player to make transfers using a service window. In various embodiments, the gaming system uses a service window to provide certain of the features described herein. In various such embodiments, the gaming system enables a player to make transfers using a service window. In various embodiments, the gaming system enables a player to view activity between the players via the service window.

In various embodiments, the gaming system can facilitate any suitable necessary hand pay at one or more of the EGM's of the system In various embodiments, the gaming system can maintain any suitable regulatory game history logs and records that show the transfers of money between the EGMs.

In various embodiments, the gaming system can, in the event of a tilt or another stoppage of an EGM, enable a player at that EGM to transfer money to a second EGM to resume game play.

In various embodiments, certain awards won on one of the EGMs may not go into the shared credit meter and may remain at the central server level or at the EGM level. For example, a jackpot award, a physical award (such as a car or a guitar) may be difficult (technically, regulatory wise, and legally) to share. Thus, the present disclosure contemplates that certain awards would not be shared. The gaming system, the operator, or other entity can decide which awards are not sharable (and can provide the appropriate notices to players regarding such awards). In various embodiments, when one of these awards are won, the player playing the game which resulted in that award could solely be provided that award, or the player who funded the game could solely be provided that award (e.g., the player who created the account or gave the credits away). In other embodiments, neither could win (for an award that cannot be shared due to a regulatory decision or otherwise). In such case, the gaming system can provide an alternative award or otherwise suitably address the situation.

It should be appreciated from the above that the gaming systems of various embodiments of the present disclosure provide numerous technical improvements. For example, certain of these improvements are apparent from the following example. In this example, a married couple Jane and John Doe go to a casino and each has a budget of $50. In this example, Jane is more successful than John, and John exhaust his budget. Prior to the employment of the present system, to give John access to any of Jane's budget, Jane must cash out at the EGM she is playing (or do a partial cash-out if enabled) to give some funds to enable John to continue to play. The gaming system of various embodiments of the present disclosure enables Jane to share synchronously (i.e., fully share Jane's credits) or asynchronously (i.e., share only portions of Janes' credit) with John. This eliminates the need for John from removing money from the ATM, or take other actions, and enables Jane to have substantially uninterrupted gaming sessions.

It should further be appreciated from the above that the gaming systems of various embodiments of the present disclosure provide a substantial improvement to gaming technology by enabling players to play EGM's adjacent to one another (such as when the players like those EGMs) while sharing a credits during a sync session, and thus promotes more use of gaming machines.

It should further be appreciated from the above that the gaming systems of various embodiments of the present disclosure provide a substantial improvement to gaming technology in reducing the quantity of tickets, ink, and related supplies for tickets. This also reduces the waste produced by such gaming systems. Also avoids the waste of time and materials. In other words, the present disclosure can reduce the amount of materials wasted based on cashout vouchers and possibly smart cards. Various embodiments eliminate the need for a first player to have to cash out to a ticket and hand it to a second player. This wastes the ticket, the computer resources to issue the ticket, and the labor required to count and record the tickets in each EGM.

It should further be appreciated from the above that the gaming systems of various embodiments of the present disclosure provide a substantial improvement to gaming technology in reducing the need to provide and maintain certain cash stations and the additional cost due to the need to secure and monitor the cash provided by such cash stations.

Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, a video bingo machine located on a casino floor, or a sports wagering terminal). Additionally, for brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. For example, the gaming system includes a plurality of EGMs that are each configured to communicate with a central server, a central controller, and/or a remote host through a data network.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a wide area network (WAN) in which one or more of the EGMs (or personal gaming devices) are not necessarily located substantially proximate to another one of the EGMs (or personal gaming devices) and/or the central server, central controller, or remote host. For example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the data network is a WAN, the gaming system includes a central server, central controller, or remote host and an EGM (or personal gaming device) each located in a different gaming establishment in a same geographic area, such as a same city or a same state. Gaming systems in which the data network is a WAN are substantially identical to gaming systems in which the data network is a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device). Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T−1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3:
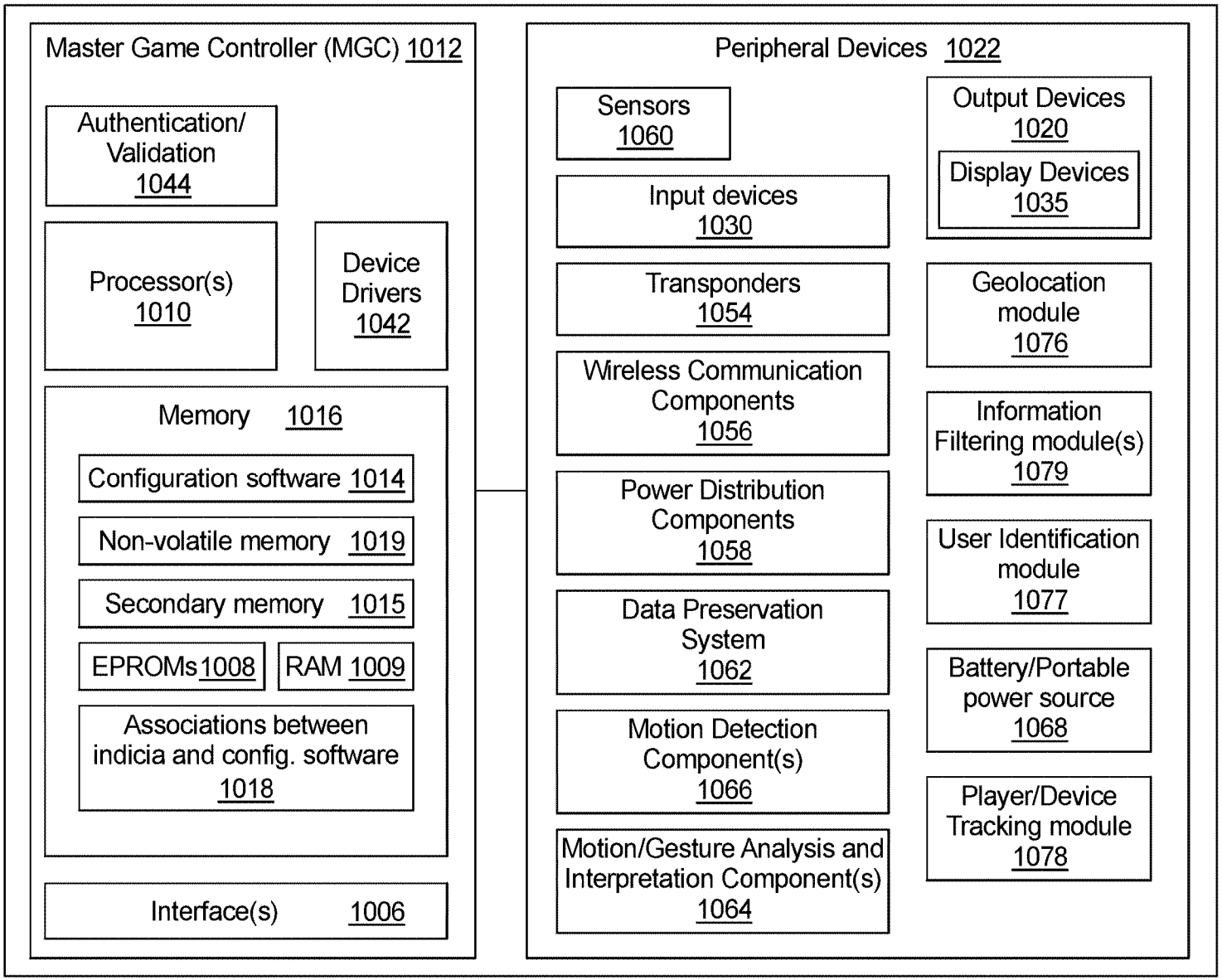
FIG. 3 is a schematic block diagram of one embodiment of an electronic configuration of an example gaming system of the present disclosure.
Figure 4A:
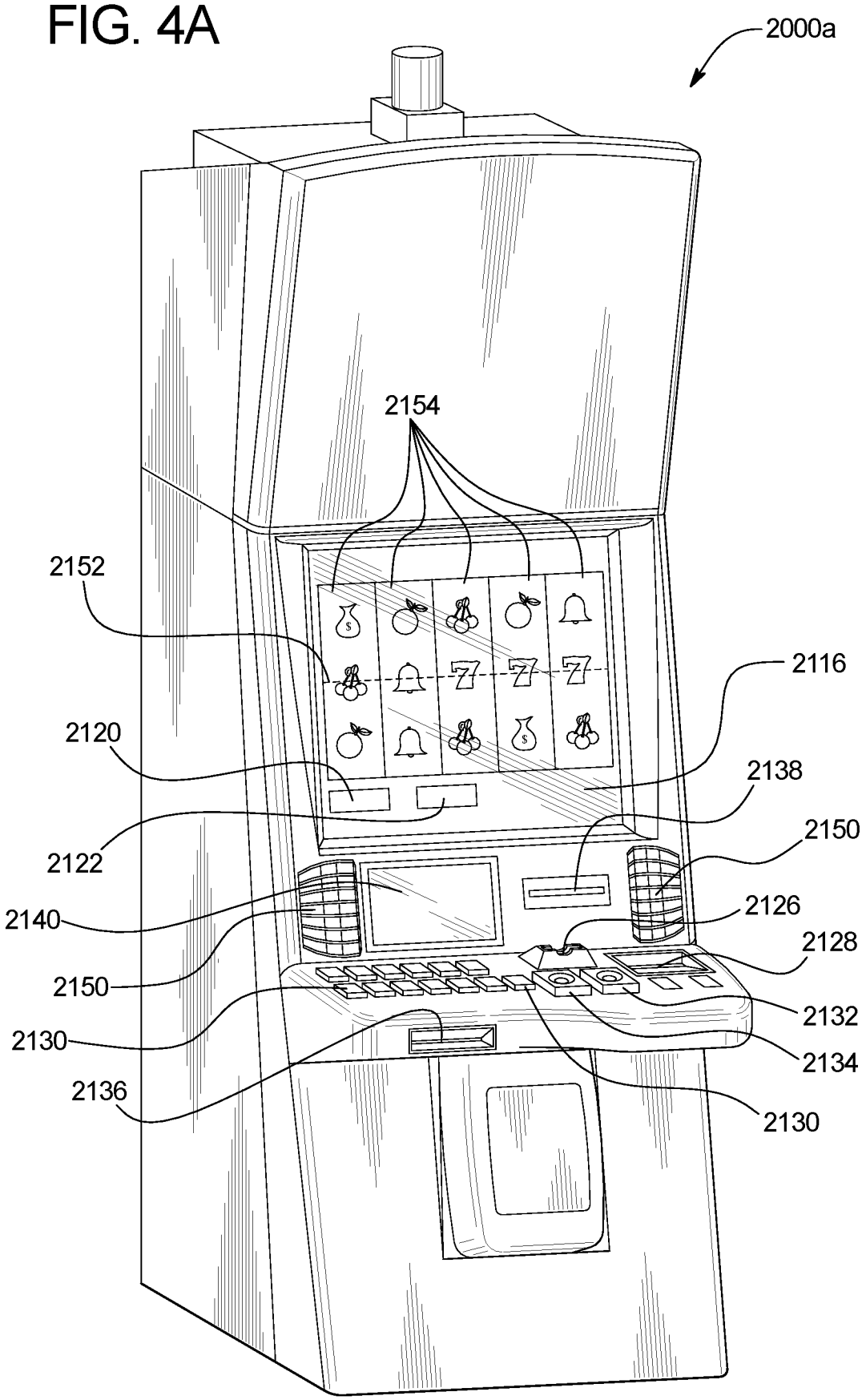
FIGS. 4A and 4B are perspective views of example alternative embodiments of the gaming system of the present disclosure.
Figure 4B:
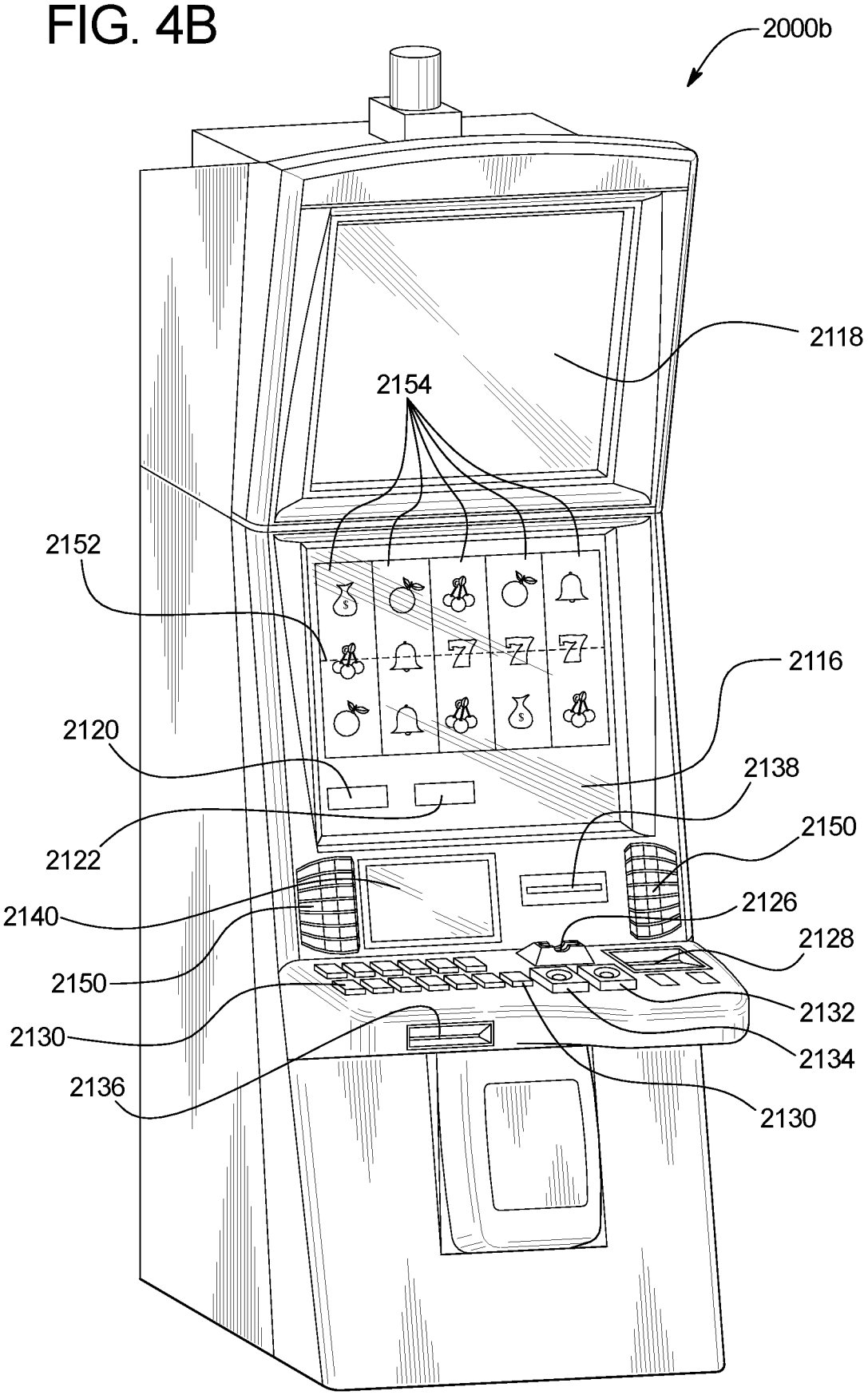
Figure 4C:
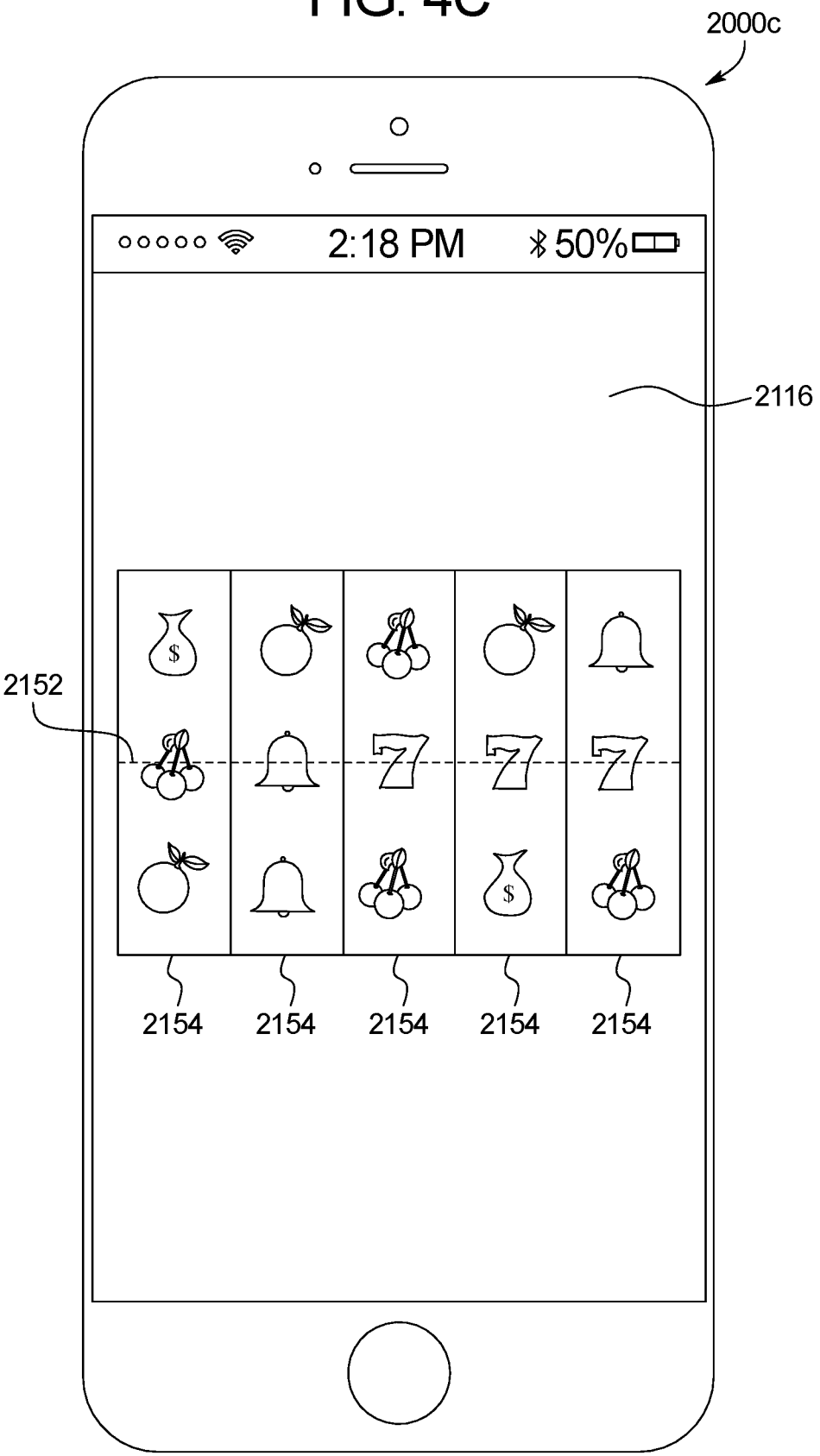
FIG. 4C is a front view of an example personal gaming device of the gaming system of the present disclosure.

FIG. 3 is a block diagram of an example EGM 1000 and FIGS. 4A and 4B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*. Although the below refers to EGMs, in various embodiments personal gaming devices (such as personal gaming device 2000*c* of FIG. 4C) may include some or all of the below components.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM. In these embodiments, any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols.

In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets."

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 4A includes a central display device 2116, a player tracking display 2140, a credit display 2120, and a bet display 2122. The example EGM 2000*b* illustrated in FIG. 4B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cash-out device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 4A and 4B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; and U.S. Pat. No. 6,048,269, entitled "Coinless Slot Machine System and Method."

In certain embodiments, rather than dispensing bills, coins, or a physical ticket having a monetary value to the player following receipt of an actuation of the cash-out device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine."

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 4A and 4B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrated in FIGS. 4A and 4B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine." When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 4A and 4B each include a game play activation device in the form of a game play initiation button 2132. In other embodiments, the EGM begins game play automatically upon appropriate funding rather than upon utilization of the game play activation device.

In other embodiments, the at least one input device 1030 includes a cash-out device. In various embodiments, the cash-out device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cash-out device from a player and the player has a positive (i.e., greater-than-zero) credit balance, the EGM initiates a payout associated with the player's credit balance. The example EGMs 2000*a* and 2000*b* illustrated in FIGS. 4A and 4B each include a cash-out device in the form of a cash-out button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 4A and 4B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 4A and 4B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 4A and 4B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 4A and 4B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM before delivery to a gaming establishment or before being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game."

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern."

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services."

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM **2000*b* shown in FIG. 4B includes a payline 1152 and a plurality of reels 1154**. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations."

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards."

As generally noted above, in addition to providing winning credits or other awards for one or more plays of the primary game(s), in various embodiments the gaming system provides credits or other awards for one or more plays of one or more secondary games. The secondary game typically enables an award to be obtained in addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, period of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win."

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services."

Web-Based Gaming

In various embodiments, the gaming system includes one or more servers configured to communicate with a personal gaming device—such as a smartphone, a tablet computer, a desktop computer, or a laptop computer—to enable web-based game play using the personal gaming device. In various embodiments, the player must first access a gaming website via an Internet browser of the personal gaming device or execute an application (commonly called an "app") installed on the personal gaming device before the player can use the personal gaming device to participate in web-based game play. In certain embodiments, the one or more servers and the personal gaming device operate in a thin-client environment. In these embodiments, the personal gaming device receives inputs via one or more input devices (such as a touch screen and/or physical buttons), the personal gaming device sends the received inputs to the one or more servers, the one or more servers make various determinations based on the inputs and determine content to be displayed (such as a randomly determined game outcome and corresponding award), the one or more servers send the content to the personal gaming device, and the personal gaming device displays the content.

In certain such embodiments, the one or more servers must identify the player before enabling game play on the personal gaming device (or, in some embodiments, before enabling monetary wager-based game play on the personal gaming device). In these embodiments, the player must identify herself to the one or more servers, such as by inputting the player's unique username and password combination, providing an input to a biometric sensor (e.g., a fingerprint sensor, a retinal sensor, a voice sensor, and/or a facial recognition sensor), and/or providing any other suitable information.

Once identified, the one or more servers enable the player to establish an account balance from which the player can draw credits usable to wager on plays of a game. In certain embodiments, the one or more servers enable the player to initiate an electronic funds transfer to transfer funds from a bank account to the player's account balance. In other embodiments, the one or more servers enable the player to make a payment using the player's credit card, debit card, or other suitable device to add money to the player's account balance. In other embodiments, the one or more servers enable the player to add money to the player's account balance via a peer-to-peer type application, such as PayPal or Venmo. The one or more servers also enable the player to cash out the player's account balance (or part of it) in any suitable manner, such as via an electronic funds transfer, by initiating creation of a paper check that is mailed to the player, and/or by initiating printing of a voucher at a kiosk in a gaming establishment.

In certain embodiments, the one or more servers include a payment server that handles establishing and cashing out players' account balances and a separate game server configured to determine the outcome and any associated award for a play of a game. In these embodiments, the game server is configured to communicate with the personal gaming device and the payment device, and the personal gaming device and the payment device are not configured to directly communicate with one another. In these embodiments, when the game server receives data representing a request to start a play of a game at a desired wager, the game server sends data representing the desired wager to the payment server. The payment server determines whether the player's account balance can cover the desired wager (i.e., includes a monetary balance at least equal to the desired wager).

If the payment server determines that the player's account balance cannot cover the desired wager, the payment server notifies the game server, which then instructs the personal gaming device to display a suitable notification to the player that the player's account balance is too low to place the desired wager. If the payment server determines that the player's account balance can cover the desired wager, the payment server deducts the desired wager from the account balance and notifies the game server. The game server then determines an outcome and any associated award for the play of the game. The game server notifies the payment server of any nonzero award, and the payment server increases the player's account balance by the nonzero award. The game server sends data representing the outcome and any award to the personal gaming device, which displays the outcome and any award.

In certain embodiments, the one or more servers enable web-based game play using a personal gaming device only if the personal gaming device satisfies one or more jurisdictional requirements. In one embodiment, the one or more servers enable web-based game play using the personal gaming device only if the personal gaming device is located within a designated geographic area (such as within certain state or county lines and/or within the boundaries of a gaming establishment). In this embodiment, the geolocation module of the personal gaming device determines the location of the personal gaming device and sends the location to the one or more servers, which determine whether the personal gaming device is located within the designated geographic area. In various embodiments, the one or more servers enable non-monetary wager-based game play if the personal gaming device is located outside of the designated geographic area.

In various embodiments, the gaming system includes an EGM configured to communicate with a personal gaming device—such as a smartphone, a tablet computer, a desktop computer, or a laptop computer—to enable tethered mobile game play using the personal gaming device. Generally, in these embodiments, the EGM establishes communication with the personal gaming device and enables the player to play games on the EGM remotely via the personal gaming device. In certain embodiments, the gaming system includes a geo-fence system that enables tethered game play within a particular geographic area but not outside of that geographic area. Examples of tethering an EGM to a personal gaming device and geo-fencing are described in U.S. Patent Appl. Pub. No. 2013/0267324, entitled "Remote Gaming Method Allowing Temporary Inactivation Without Terminating Playing Session Due to Game Inactivity."

Social Network Integration

In certain embodiments, the gaming system is configured to communicate with a social network server that hosts or partially hosts a social networking website via a data network (such as the Internet) to integrate a player's gaming experience with the player's social networking account. This enables the gaming system to send certain information to the social network server that the social network server can use to create content (such as text, an image, and/or a video) and post it to the player's wall, newsfeed, or similar area of the social networking website accessible by the player's connections (and in certain cases the public) such that the player's connections can view that information. This also enables the gaming system to receive certain information from the social network server, such as the player's likes or dislikes or the player's list of connections. In certain embodiments, the gaming system enables the player to link the player's player account to the player's social networking account(s). This enables the gaming system to, once it identifies the player and initiates a gaming session (such as via the player logging in to a website (or an application) on the player's personal gaming device or via the player inserting the player's player tracking card into an EGM), link that gaming session to the player's social networking account(s). In other embodiments, the gaming system enables the player to link the player's social networking account(s) to individual gaming sessions when desired by providing the required login information.

For instance, in one embodiment, if a player wins a particular award (e.g., a progressive award or a jackpot award) or an award that exceeds a certain threshold (e.g., an award exceeding $1,000), the gaming system sends information about the award to the social network server to enable the server to create associated content (such as a screenshot of the outcome and associated award) and to post that content to the player's wall (or other suitable area) of the social networking website for the player's connections to see (and to entice them to play). In another embodiment, if a player joins a multiplayer game and there is another seat available, the gaming system sends that information to the social network server to enable the server to create associated content (such as text indicating a vacancy for that particular game) and to post that content to the player's wall (or other suitable area) of the social networking website for the player's connections to see (and to entice them to fill the vacancy). In another embodiment, if the player consents, the gaming system sends advertisement information or offer information to the social network server to enable the social network server to create associated content (such as text or an image reflecting an advertisement and/or an offer) and to post that content to the player's wall (or other suitable area) of the social networking website for the player's connections to see. In another embodiment, the gaming system enables the player to recommend a game to the player's connections by posting a recommendation to the player's wall (or other suitable area) of the social networking website.

Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes."

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just before the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum period of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just before when the malfunction occurred. The restored state may include metering information and graphical information that was displayed on the EGM in the state before the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just before the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM before, during, and/or after the disputed game to demonstrate whether the player was correct or not in the player's assertion. Examples of a state-based EGM , recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play."

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents in a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification."

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment."

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System."

Various changes and modifications to the present embodiments described herein will be apparent to those skilled in the art. Such changes and modifications can be made without departing from the spirit and scope of the present subject matter and without diminishing its intended technical scope. It is therefore intended that such changes and modifications be covered by the appended claims.

The claims are as follows:

1. A gaming system comprising:

a processor; and a memory device storing a plurality of instructions, that when executed by the processor, cause the processor to:

receive first credit data regarding a first credit amount on a first individual credit meter of a first electronic gaming machine, and displayed via the first individual credit meter of a first display device of the first electronic gaming machine, receive second credit data regarding a second credit amount on a second individual credit meter of a second electronic gaming machine, and displayed via the second individual credit meter of a second display device of the second electronic gaming machine, wherein the first credit amount and the second credit amount are simultaneously displayed by the respective first individual credit meter and the second individual credit meter, based on the first credit data and the second credit data, calculate and store in the memory device a joint credit balance comprising a sum of the first credit amount and the second credit amount, communicate data that results in the first electronic gaming machine displaying, via the first display device, the joint credit balance in a first joint credit meter of the first electronic gaming machine, and communicate data that results in the second electronic gaming machine displaying, via the second display device, the joint credit balance in a second joint credit meter of the second electronic gaming machine, such that the joint credit balance is simultaneously displayed by the first joint credit meter and the second joint credit meter and simultaneously displayed with the first credit amount and the second credit amount displayed by the respective first individual credit meter and the second individual credit meter.

2. The gaming system of claim 1, wherein, responsive to a change of one of the first credit amount and the second credit amount, the plurality of instructions, when executed by the processor, cause the processor to, make a corresponding change to the joint credit balance, communicate data that results in the first electronic gaming machine displaying, via the first display device, the changed joint credit balance in the first joint credit meter, and communicate data that results in the second electronic gaming machine displaying, via the second display device, the changed joint credit balance in the second joint credit meter.

3. The gaming system of claim 2, wherein the change to one of the first credit amount and the second credit amount comprises one of: a wager amount deducted from the first individual credit meter for a play of a first wagering game of the first electronic gaming machine, a wager amount deducted from the second individual credit meter for a play of a second wagering game of the second electronic gaming machine, an amount added to the first individual credit meter from a play of the first wagering game, an amount added to the second individual credit meter from a play of the second wagering game, a cash-out of the first individual credit meter, a cash-out of the second individual credit meter, a player deposit of a first amount of funds to the first individual credit meter, and a player deposit of a second amount of funds to the second individual credit meter.

4. The gaming system of claim 1, wherein responsive to an occurrence of a credit transfer triggering event, the plurality of instructions, when executed by the processor, cause the processor to cause a transfer of credits from the first individual credit meter to the second individual credit meter without causing a change to the joint credit balance.

5. The gaming system of claim 4, wherein the credit transfer triggering event comprises one of: the first individual credit meter reaching a first designated credit level and the second individual credit meter reaching a second designated credit level.

6. The gaming system of claim 4, wherein the credit transfer triggering event comprises one of: a first input received via a first input device of the first electronic gaming machine, and a second input received via a second input device of the second electronic gaming machine.

7. The gaming system of claim 1, wherein the plurality of instructions, when executed by the processor, cause the processor to, receive from the first electronic gaming machine, data associated with a player input associated with a credit transfer condition for causing a credit transfer between the first individual credit meter of the first electronic gaming machine and the second individual credit meter of the second electronic gaming machine.

8. The gaming system of claim 7, wherein the credit transfer condition is based on an amount of one of the first individual credit meter and the second individual credit meter.

9. The gaming system of claim 1, wherein, the plurality of instructions, when executed by the processor, cause the processor to, maintain the joint credit balance in an account maintained by a gaming establishment fund management system.

10. The gaming system of claim 1, wherein the plurality of instructions, when executed by the processor, cause the processor to receive, from the first electronic gaming machine, player fund data based a monetary value associated with a physical item received by an acceptor of the first electronic gaming machine.

11. A gaming system comprising:

a processor; and a memory device storing a plurality of instructions, that when executed by the processor, cause the processor to:

maintain a joint credit balance for each of a first electronic gaming machine and a second electronic gaming machine, communicate data that results in a display of the joint credit balance in a first joint credit meter via a first display device of the first electronic gaming machine, communicate data that results in a display of the joint credit balance in a second joint credit meter via a second display device of the second electronic gaming machine, such that the joint credit balance is simultaneously displayed by the first joint credit meter and the second joint credit meter, communicate data that results in a first credit amount equal to the joint credit balance to be displayed via a first individual credit meter of the first display device of the first electronic gaming machine, and communicate data that results in a second credit amount equal to a zero balance to be displayed via a second individual credit meter of the second display device of the second electronic gaming machine, such that the joint credit balance is a sum of the first credit amount and the second credit amount, and such that the first credit amount and the second credit amount are simultaneously displayed by the respective first individual credit meter and the second individual credit meter, and simultaneously displayed with the joint credit balance simultaneously displayed by the first joint credit meter and the second joint credit meter.

12. The gaming system of claim 11, wherein, responsive to a change of the first credit amount, the plurality of instructions, when executed by the processor, cause the processor to, make a corresponding change to the joint credit balance, communicate data that results in the first electronic gaming machine displaying, via the first display device, the changed joint credit balance in the first joint credit meter, and communicate data that results in the second electronic gaming machine displaying, via the second display device, the changed joint credit balance in the second joint credit meter.

13. The gaming system of claim 12, wherein the change to the first credit amount comprises one of: a wager amount deducted from the first individual credit meter for a play of a first wagering game of the first electronic gaming machine, a wager amount deducted from the first individual credit meter for a play of a second wagering game of the second electronic gaming machine, an amount added to the first individual credit meter from a play of the first wagering game, an amount added to the first individual credit meter from a play of the second wagering game, a cash-out of the first individual credit meter, and a player deposit of a first amount of funds to the first individual credit meter.

14. The gaming system of claim 11, wherein the plurality of instructions, when executed by the processor, cause the processor to receive, from the first electronic gaming machine, player fund data based a monetary value associated with a physical item received by an acceptor of the first electronic gaming machine.

15. A gaming system comprising:

a processor; and a memory device storing a plurality of instructions, that when executed by the processor, cause the processor to:

cause a joint account maintained by a gaming establishment fund management system to maintain a joint credit balance for a first electronic gaming machine and a second electronic gaming machine, communicate data that results in a display of the joint credit balance in a first joint credit meter via a first display device of the first electronic gaming machine, communicate data that results in a display of the joint credit balance in a second joint credit meter via a second display device of the second electronic gaming machine, such that the joint credit balance is simultaneously displayed by the first joint credit meter and the second joint credit meter, communicate data that results in a first credit amount equal to a zero balance to be displayed via a first individual credit meter of the first display device of the first electronic gaming machine, and communicate data that results in a second credit amount equal to a zero balance to be displayed via a second individual credit meter of the second display device of the second electronic gaming machine, such that the first credit amount and the second credit amount are simultaneously displayed by the respective first individual credit meter and the second individual credit meter, and simultaneously displayed with the joint credit balance simultaneously displayed by the first joint credit meter and the second joint credit meter.

16. The gaming system of claim 15, wherein, responsive to a change of the joint credit balance, the plurality of instructions, when executed by the processor, cause the processor to, make a corresponding change to the joint account, communicate data that results in the first electronic gaming machine displaying, via the first display device, the changed joint credit balance in the first joint credit meter, and communicate data that results in the second electronic gaming machine displaying, via the second display device, the changed joint credit balance in the second joint credit meter.

17. The gaming system of claim 16, wherein the change to the joint account comprises one of: a wager amount deducted from the joint credit balance for a play of a first wagering game of the first electronic gaming machine, a wager amount deducted from the joint credit balance for a play of a second wagering game of the second electronic gaming machine, an amount added to the joint credit balance from a play of the first wagering game, and an amount added to the joint credit balance from a play of the second wagering game.

18. The gaming system of claim 15, wherein the plurality of instructions, when executed by the processor, cause the processor to receive from the first electronic gaming machine data associated with a player input associated with a credit transfer condition for accessing the joint credit balance.

19. The gaming system of claim 18, wherein the credit transfer condition limits an amount that can be wagered on the second electronic gaming machine.

20. The gaming system of claim 15, wherein the plurality of instructions, when executed by the processor, cause the processor to receive, from the first electronic gaming machine, player fund data based a monetary value associated with a physical item received by an acceptor of the first electronic gaming machine.

* * * * *